US006306461B1

(12) United States Patent
Leino et al.

(10) Patent No.: US 6,306,461 B1
(45) **Date of Patent: *Oct. 23, 2001**

(54) METHOD AND APPARATUS FOR COATING PAPER BOARD AND PAPER WITH HIGH-VISCOSITY COATING MIXES

(75) Inventors: Mika Leino, Järvenpää (FI); Stig Renvall, Charlotte, NC (US); Stefan Kuni, Järvenpää (FI); Petri Paloviita, Appleton, WI (US)

(73) Assignee: Valmet Corporation, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 09/423,272

(22) PCT Filed: May 7, 1998

(86) PCT No.: PCT/US98/09314

§ 371 Date: Dec. 17, 1999

§ 102(e) Date: Dec. 17, 1999

(87) PCT Pub. No.: WO98/50169

PCT Pub. Date: Nov. 12, 1998

Related U.S. Application Data

(60) Provisional application No. 60/046,134, filed on May 9, 1997.

(51) Int. Cl.[7] ..... B05D 3/12

(52) U.S. Cl. ..... 427/356; 427/361; 118/119; 118/126; 118/410; 118/413; 118/414

(58) Field of Search ..... 427/356, 361; 118/119, 126, 410, 413, 414

(56) References Cited

U.S. PATENT DOCUMENTS

| | | | |
|---|---|---|---|
| 5,104,697 | 4/1992 | Heikkinen et al. . | |
| 5,112,653 | 5/1992 | Damrau et al. | 427/356 |
| 5,510,150 | 4/1996 | Koskinen . | |
| 5,674,551 | 10/1997 | Koskinen et al. . | |
| 5,741,550 | 4/1998 | Paloviita et al. . | |

FOREIGN PATENT DOCUMENTS

| | | |
|---|---|---|
| 2272850A | 6/1994 | (GB) . |

*Primary Examiner*—Katherine A. Bareford
(74) *Attorney, Agent, or Firm*—Cohen, Pontani, Lieberman & Pavane

(57) ABSTRACT

A method and apparatus for coating a paper or a paper board web, comprising spreading coating mix having a solids content of 55–75% on the surface of the web with a nozzle applicator, levelling and metering the spread coating mix on the surface of the web by a doctor element capable of producing a high hydrodynamic force on the coating layer between the doctor element and the web, the doctor element being located downstream of the applicator so that the dwell time between the spreading of the coating mix to the metering is 72–2400 ms. The web speed is preferably 100–1000 m/s. A good smoothness and coverage is achieved by this method due to long dwell time.

23 Claims, 11 Drawing Sheets

COATING WITH THE SYM-SIZER
C2S CONCEPT

DETERMINING OF FORCES AFFECTING THE METERING ELEMENT

METHOD AND APPARATUS FOR COATING PAPER BOARD AND PAPER WITH HIGH-VISCOSITY COATING MIXES

This is a national stage application of PCT/US98/09314, filed May 7, 1998, which application claimed the benefit of priority of US Provisional Application Ser. No. 60/046,134, filed May 9, 1997.

FIELD OF THE INVENTION

The present invention relates to coating of paper and especially paper board with high-viscosity coating mixes in order to achieve good coverage together with good smoothness of the coating layer.

BACKGROUND OF THE INVENTION

In paper board coating the operating speeds are increasing since productivity demands are getting constantly higher. This concerns also coating of paper. Very often a good coverage of the coated layer is of great importance for the quality of the final product. The coverage effects many quality properties of the final product such as gloss uniformity, uniform ink absoption, good and uniform brightness etc. The coverage is of extreme importance in coating of webs having low brightness such as cardboard or paper grades that have not been bleached in full and some grades where recycled fibers and low intensity bleaching are used.

An excellent device for producing such coatings is an air knife coater. In this apparatus the coating mix is spread on a moving web with an applicator roll or a nozzle applicator and the excess coating is scraped away with a thin air jet blown from an air knife. These apparatuses are well known in paper and board manufacturing. At present, the air knife is a bottleneck of the coating process due to its limited capacity to operate at the high speed required in modern processes. The air knife requires regular cleaning which leads to down time, the coating color solids are limited to 40–50% and the smoothness of the final product is poor according to present standards. The air knife also takes a lot of space in the lay-out, it is noisy and a lot of coating mix mist is entrained in the exhaust air causing cleaning problems. A typical problem relating to the quality of the final product in air knife coating is poor smoothness of the coating surface caused by the contour type coverage.

In air knife coating, there is a determinable dwell time between the application of the coating mix and the air knife doctoring. During this dwell time, a settled coating layer is formed on the web to be coated and excess free coating is blown away from the web by the air knife. The coating layer left on the web is contoured according to the form of the web surface and the coating layer thus has a very uniform thickness. Also the coat weights are normally high (8–22 $g/m^2$). The blow off capacity of the air doctor limits the operation range of the coating apparatus to typical solids content of mineral coating mixes of 25–55% and to web speeds of 50–600 m/min.

A contoured type coverage can be achieved also with a film transfer coating apparatus. In such an apparatus the coating film is first made on a rotating roll and then transferred onto the surface of a web travelling on the film transfer roll. Film transfer coaters can operate at speeds up to 2000 m/min. and with solids contents up to 70%. However, film transfer apparatuses are not capable of producing high coat weights. A typical upper range for coat weight is 10–12 $g/m^2$. The absorption characteristics of the applicator roll and the web determine the filmslit surface after the application nip and this determines the achievable maximum coat weight left on the web after the film split. In addition, the uniformity of the on the web is determined by the absorption characteristics of the web. If the absorption characteristics of the web change, for example due to moisture variation in the machine or cross-machine direction of the web, the quality of the final product may be effected.

The air knife coaters and film transfer coaters are not capable of producing as smooth coating as blade coaters which are superior in this aspect.

SUMMARY OF THE INVENTION

According to the present invention, a coating mix having a solids content of 55–75% is spread on the web and the excess coating is doctored from the web by using a high metering pressure and the dwell time between application and doctoring is 72–2400 ms, preferably between 72 and 1212 ms.

According to the other aspects of the present invention, the coating is spread on the web with a free nozzle or blade or rod metered nozzle applicator and the coating mix layer is doctored by a rod or a blade doctor operating on a hydrodynamic coating mix film formed on the web.

Further, the backing roll of the doctoring element is a compressible roll that allows deformation of the roll surface under the doctoring device.

Other objects and features of the invention will become apparent from the following detailed description considered in conjunction with the accompanying drawings. It is to be understood, however, that the drawings are intended solely for purposes of illustration and not as a definition of the limits of the invention, for which reference should be made to the appended claims.

DETAILED DESCRIPTION OF THE PRESENTLY PREFERRED EMBODIMENTS

Figure 1:
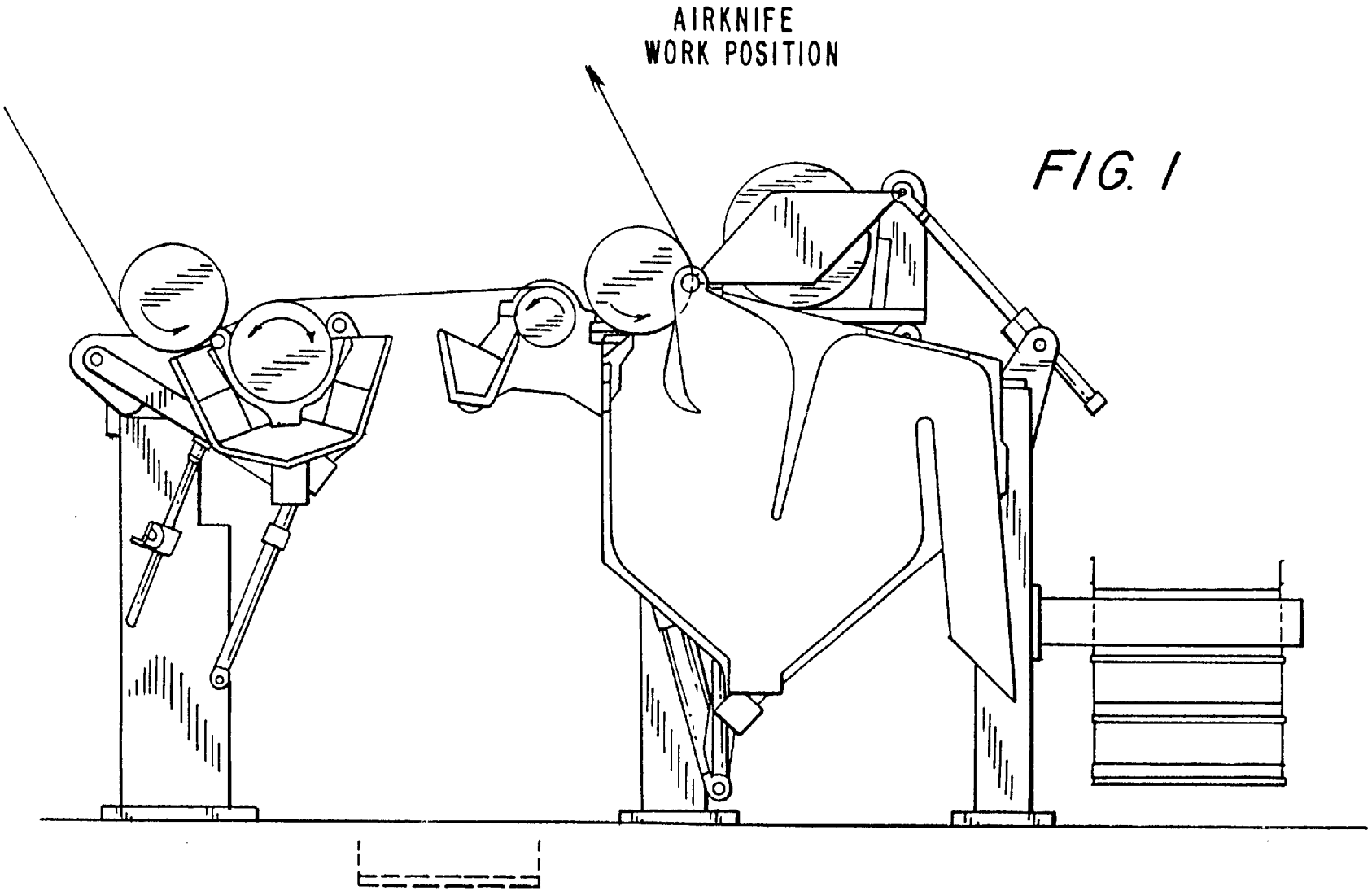
FIG. 1 shows schematically a known air knife coating apparatus.
Figure 2:
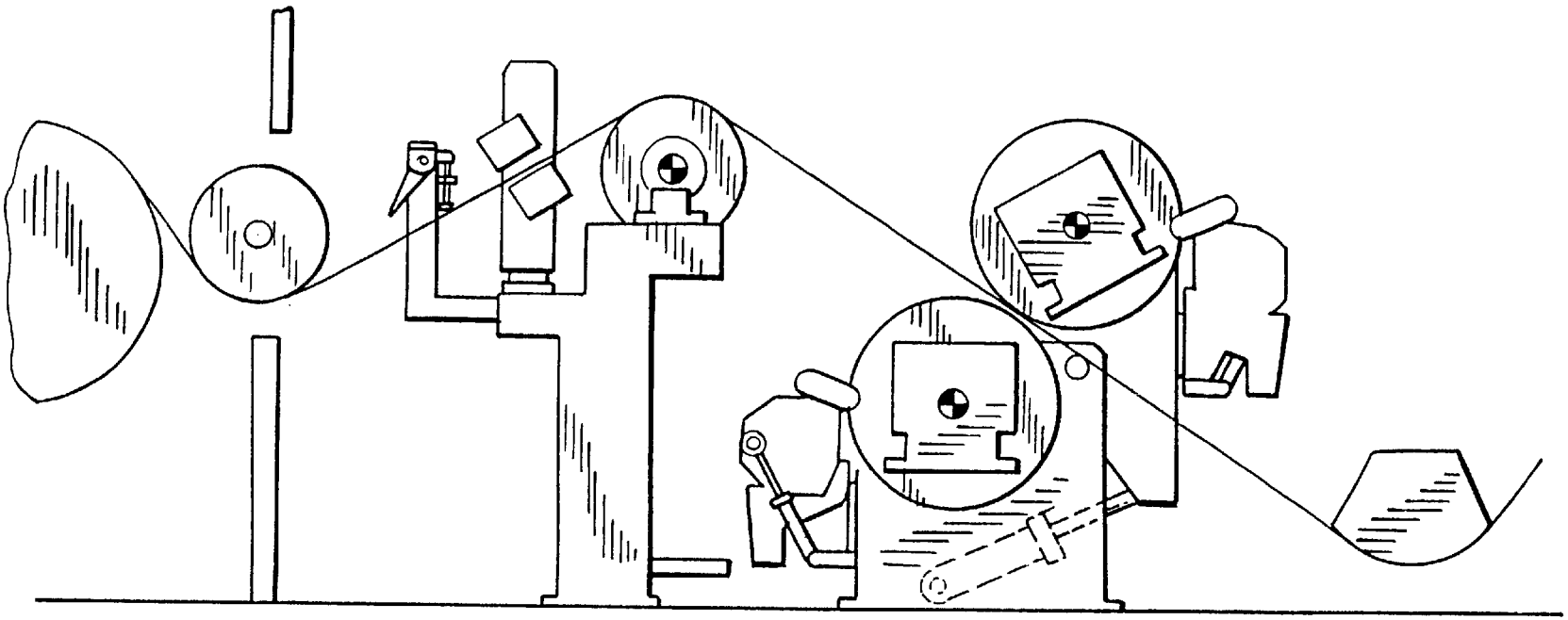
FIG. 2 shows schematically a known film transfer coating apparatus.

Apparatuses described in FIGS. 1 and 2 are well known in the art of paper and paper board manufacturing and they are shown here only as illustrations of presently used coating methods described above. Hence no detailed description of these apparatuses is included here.

Figure 3:
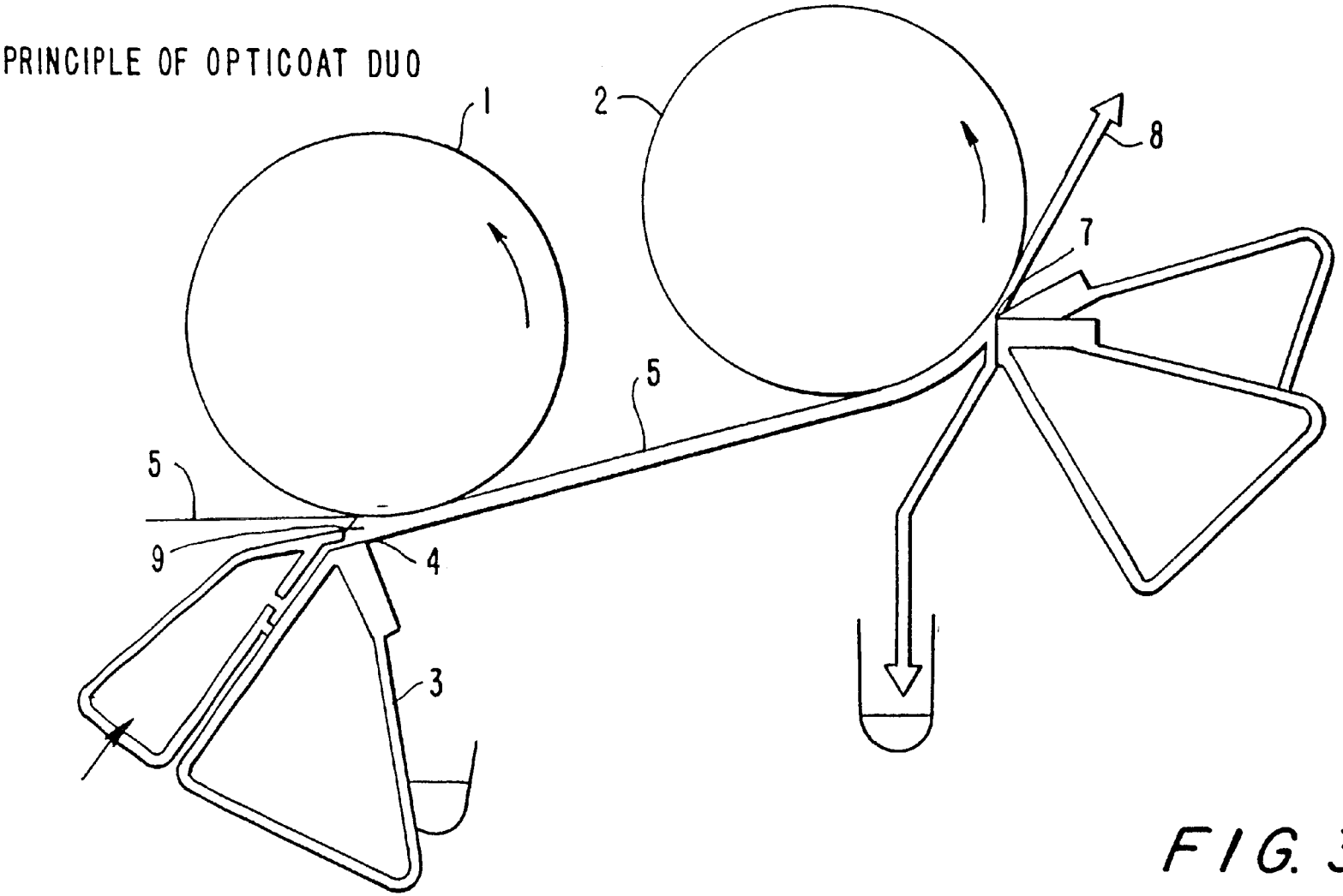
FIG. 3 shows schematically an apparatus for implementation of the invention.

FIG. 3 shows a coating apparatus suitable for implementation of the invention. This apparatus include two backing rolls 1, 2, an applicator apparatus 3 adapted to operate together with the first backing roll 1 and a doctoring means 7 operating with the second backing roll 2. The doctoring means may be a blade, or a smooth or a grooved rod. The web 5 to be coated is directed to the first backing roll 1 and it runs between the applicator apparatus 3 and the backing roll 1. The applicator apparatus 3 comprises a nozzle 9 extending over the web in cross direction for feeding a coating mix on the web 5. The amount of spread coating mix is controlled with a presmoothing blade 4 that is pressed against the web 5. When coating mix is pumped from the nozzle 9 it is levelled and metered on the web 5 by the presmoothing blade 4 whereby a coating layer 6 attaches to the web 5. Next, the web 5 travels to the second backing roll 2 and runs between the roll 2 and the doctoring means 7. The doctoring means meters and levels the coating layer on its final thickness leaving a final coating layer 8 on the web.

Figure 4:
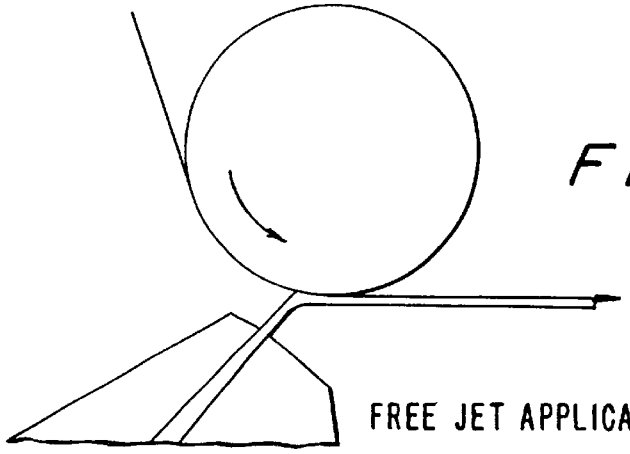
FIG. 4 shows schematically a free-jet applicator.
Figure 5:
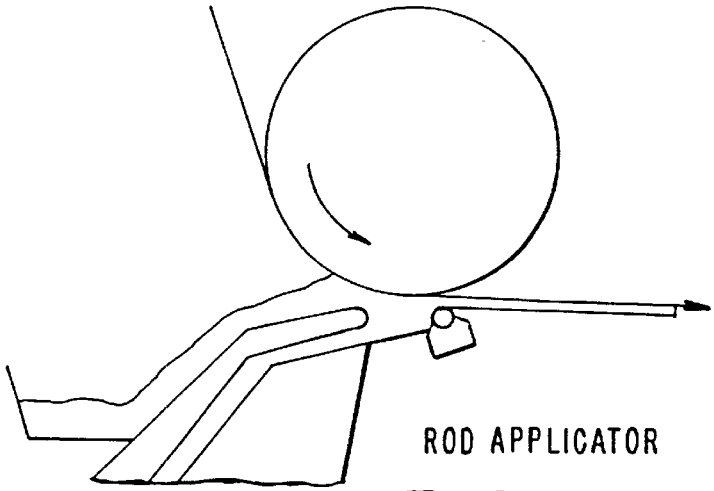
FIG. 5 shows schematically a rod metered jet applicator.
Figure 6:
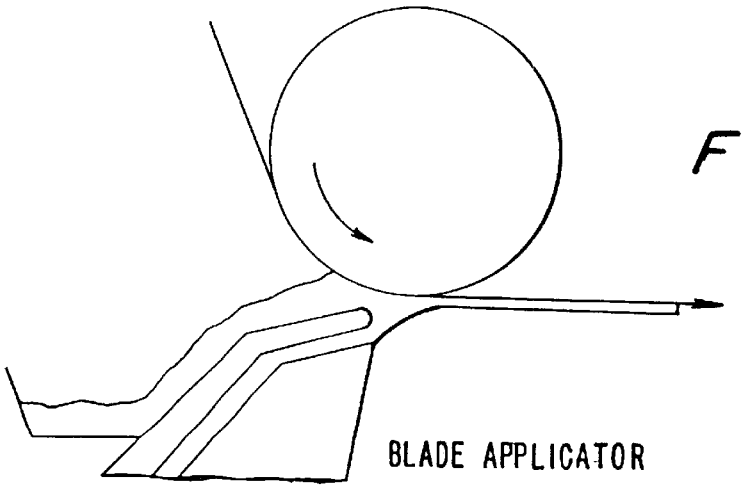
FIG. 6 shows schematically a blade metered jet applicator.

FIGS. 4, 5 and 6 show differences of free, blade metered and rod metered nozzle applicators. In a nozzle applicator the coating mix is spread on the web simply by injecting it through a nozzle and all of the injected coating mix is attached to the web. In a blade or rod metered applicator an outcoming slot is formed between the web and and the premetering means and the amount of the coating mix adhered on the web is determined by the premetering force and the width of the slot. All of these applicators are familiar to a person skilled in the art of coating moving paper material webs and more detailed description of these may therefore be omitted. Nozzle applicators are preferred in this method because of their short and low-pressure application impulse whereby the penetration of coating mix and water on the web during the application is at a minimum.

The invention may be implemented with different kinds of application and doctoring means. According to the invention, a good smoothness is achieved by using relatively long dwell time between application of the coating mix and final metering or levelling of the coating layer. The long dwell time gives the web time to swell to its equilibrium state when water phase of the coating mix is absorbed into the web. This preswelling of the fibers of the web before doctoring ensures that no or a minimum amount of swelling occurs after doctoring whereby the swelling fibers do not affect the thickness or smoothness of the final coating layer. Therefore no or little roughening occurs after the final metering which guarantees good end smoothness.

A good coverage is ensured by so called contour coating wherein the thickness of the coating layer on the surface form of the web is uniform. Normally, this kind of surface layer would lead to decrease of the smoothness, but because of fiber preswelling and a special kind of doctoring, a good coverage can be combined. Sufficient thickness is achieved by utilizing relatively high hydrodynamic pressure under the metering element. High pressure is achieved by using a long dwell time, high-shear viscosity of the partially settled coating layer having also a high initial solids content. If shorter dwell times or lower solids contents were used, the metering element would scrape all or almost all coating mix of the web if high doctoring forces were used. The high metering pressure compresses the web and the backing roll during metering making it possible to create a thick coating film between the web and the doctoring element that has even thickness. Because of the compression of the web and the backing roll, the contour type coating layer formed is better or close to the contour coatings achieved with air doctor coating devices, for example with regard to coverage and smoothness.

The main factors effecting the coating process according to the invention are composition of the coating mix, especially the solids content, application pressure, amount of the applied coating, dwell time, dewatering of the coating mix after application, viscosity of the coating mix during metering, metering pressure, compressibility of the web and the backing roll and the diameter of the metering element when a doctor rod is used.

The coating mix used may be water dispersion of mineral coating materials, binders and additives. Typical solids content of the coating mix used is 55–75%. The coating mix is applied on the web with a nozzle applicator unit which may be a free jet applicator, a blade metered applicator or a rod metered applicator. The backing element of the applicator may be a compressible or non-compressible roll or a shoe or similar backing element. The coating mix is metered by a metering rod, which may be grooved or smooth, or a doctoring blade. The rod is preferably rotated and the doctor blade is a small angle blade (bent blade) wherein a hydrodynamic foil is formed under the blade. In trial tests of the invention, better coverage was achieved with a doctoring rod and better smoothness with a blade doctor. The backing element of the doctor element is preferably a compressible roll, but for example shoe or other backing elements may be used. On thicker and compressible grades a non-compressible backing element may be used in special conditions.

The dwell time plays an important role in the coverage and smoothness of the final coating layer. The distance between the application unit and the metering unit determines the dwell time between application and doctoring if the web speed does not change and this distance may vary between 1200–4000 mm. In the web speed range of 100–1000 m/min the dwell time is between 72–2400 ms. Preferably, the dwell distance is between 1400 and 4000 mm, and the web speed is between 200 and 1000 m/s. With a longer dwell time it may be expected, that

- more dewatering of the coating mix occurs before metering,
- fiber swelling before metering increases,
- a thicker semi-solidified settled layer (filter cake) is built on the web.

As result of these factors it may be expected, that

- higher metering pressure is required to achieve certain final coat weight (better coverage),
- the portion of the settled coating forming a contoured filter cake on the web increases (better coverage),
- the roughening after metering is minimized.

In order to achieve long dwell distance and time, two backing elements are preferably used. However, it is possible to use a large single backing roll if the dwell distance can made longer than 1200 mm. In this case, the backing roll is preferably compressible. Of course, the dwell distance can be made adjustable.

One important aspect of the invention is the use of a high doctoring force enabled by the high initial solids content of the coating mix and the long dwell time. In this context, the doctoring force should be equal to or higher than the force under a smooth rotating doctoring rod having a diameter of 12 mm with a 1.2 bar tube pressure applied on the back side of the rod bed. This force is 1.0 kN/m.

Figure 12:
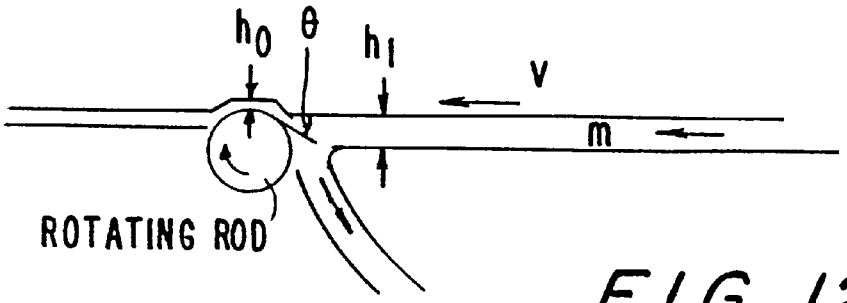
FIG. 12 is a diagram showing the forces present in the rod doctoring process.

The doctoring force $F_M$ for a smooth rod can be determined as a sum of mechanical contact force $F_0$, the impulse force from the coating mix on the doctor rod $F_1$ and the hydrodynamic force $F_H$. These forces are shown in FIG. 12.

$$F_M=F_0+F_1+F_H \quad (1)$$

$F_0$ is assumed to be zero as it is assumed that a film of coating exists constantly between the web and the rod.

$$F_1=\{m\times v\ (1+\cos\theta)\}/\sin\theta \quad (2)$$

m=applied amount of coating v=speed

θ=angle between metering element and the web, dependent on the metering element (rod diameter, blade) and compressibility of the backing roll and the web $$F_H=(6\times\eta\times v)/\tan^2\theta(\ln(1+k)-2k/(2+k)) \quad (3)$$

η=viscosity at applied shear $k=h_1/h_0-1$ $h_1$=thickness of the applied coating layer at the point where the hydrodynamic force starts to effect $h_0$=coating thickness under the doctoring element The preferably operating conditions of the invention are Application pressure: from zero upwards Amount of applied coating: 30–800 g/m$^2$ Viscosity during metering: 80–140 mPas measured in a capillary viscosimeter at 200 000–650 000 1/s shear rate Doctoring force: at least 1.0 kN/m Doctored red coat weight: 8–25 g/m$^2$ The benefits of the invention are presented in following with reference to pilot trials.

Figure 7:
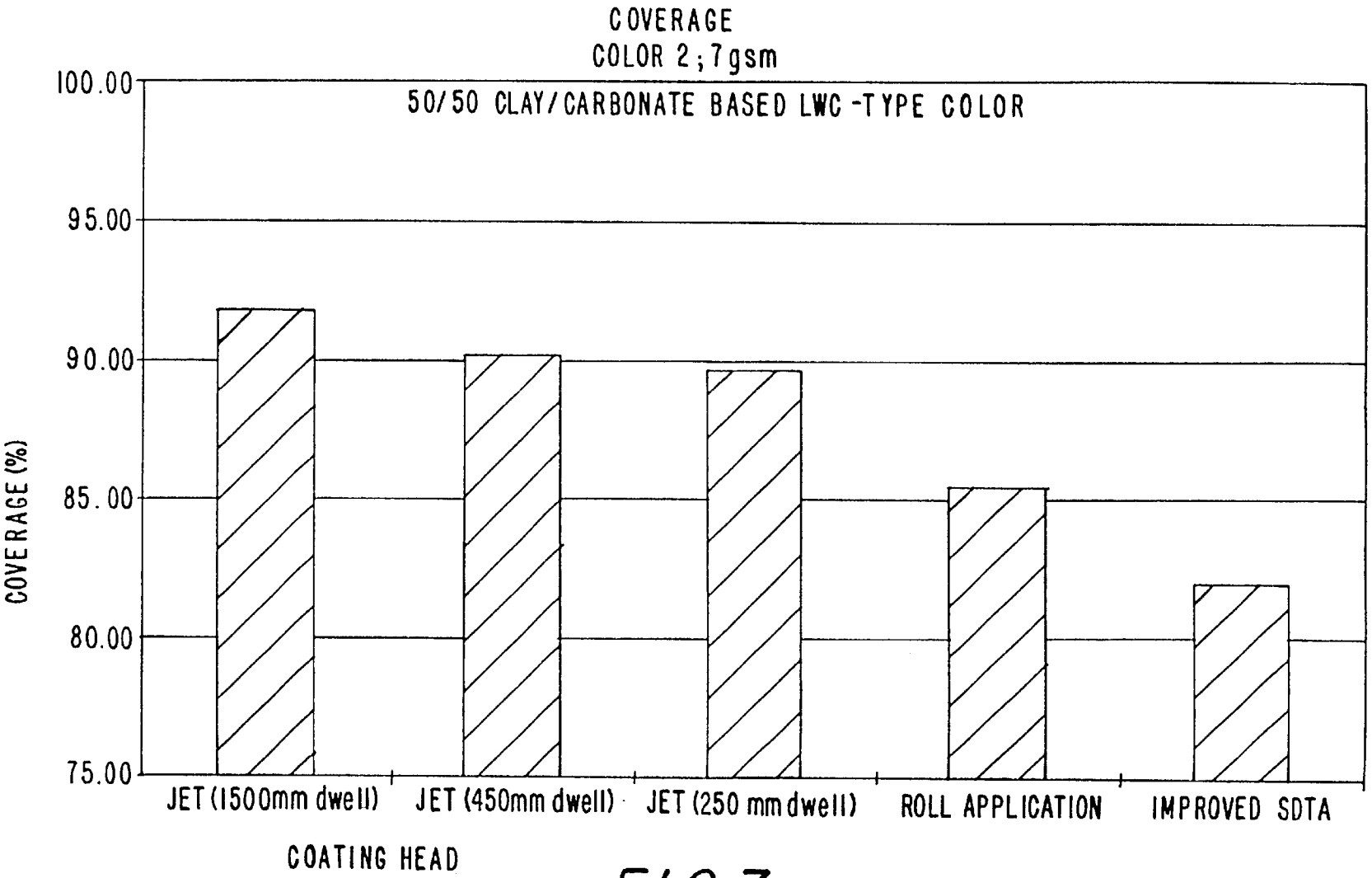
FIG. 7 is a diagram presenting results of a comparative trial test run.

FIG. 7 shows that increased dwell time gives better coverage with constant coat weight. The coverage measurement was done by a laser ablation method developed by the University of Jyväskylä, Finland. In this figure, the fifth bar shows the coverage obtained with an improved SDTA (short dwell time applicator) and fourth bar with a roll applicator coater. The dwell distance in SDTA is 60 mm and the coverage is the worst. In the roll applicator the dwell distance is 600 mm, but the application pressure is much higher than in other coaters and the coating mix is penetrated more into the base material web. The first three bars show that coverage is better when dwell distance is increased. Dwell distance is shown under the bars. All trial points have been run with same kind of application and metering and the only variable is the dwell time.

Figure 8:
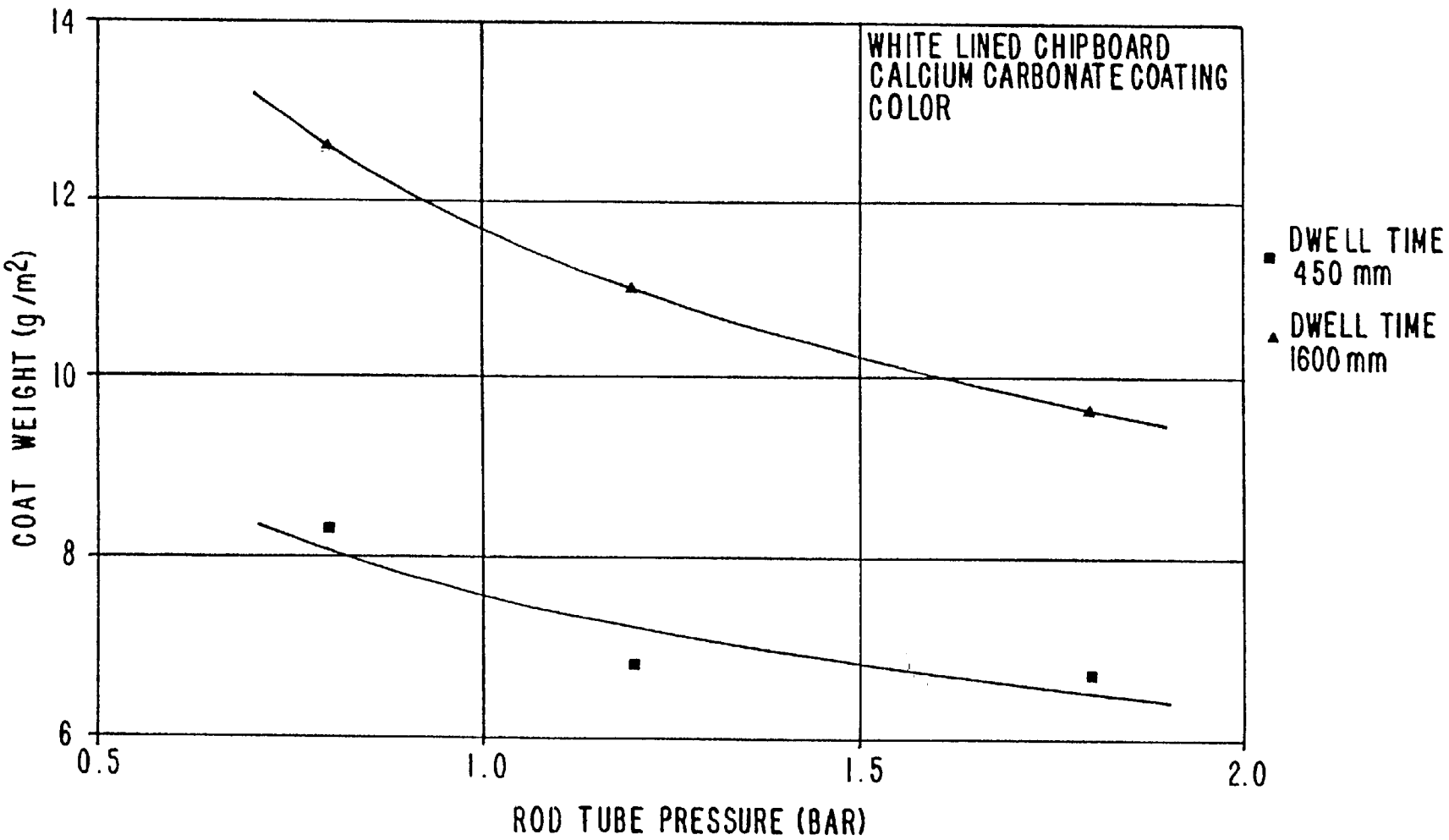
FIG. 8 is a diagram presenting the relation of the coat weight to the tube pressure of a doctor rod.

The effect of the dwell time on the thickness of the final coating layer and the doctoring pressure is shown in FIG. 8. The trials were run with a rotating doctor bar having a diameter of 12 mm. It can be seen that the coat weight is about 3 g/m$^2$ higher on dwell distance of 1600 mm than on distance of 450 mm.

Figure 9:
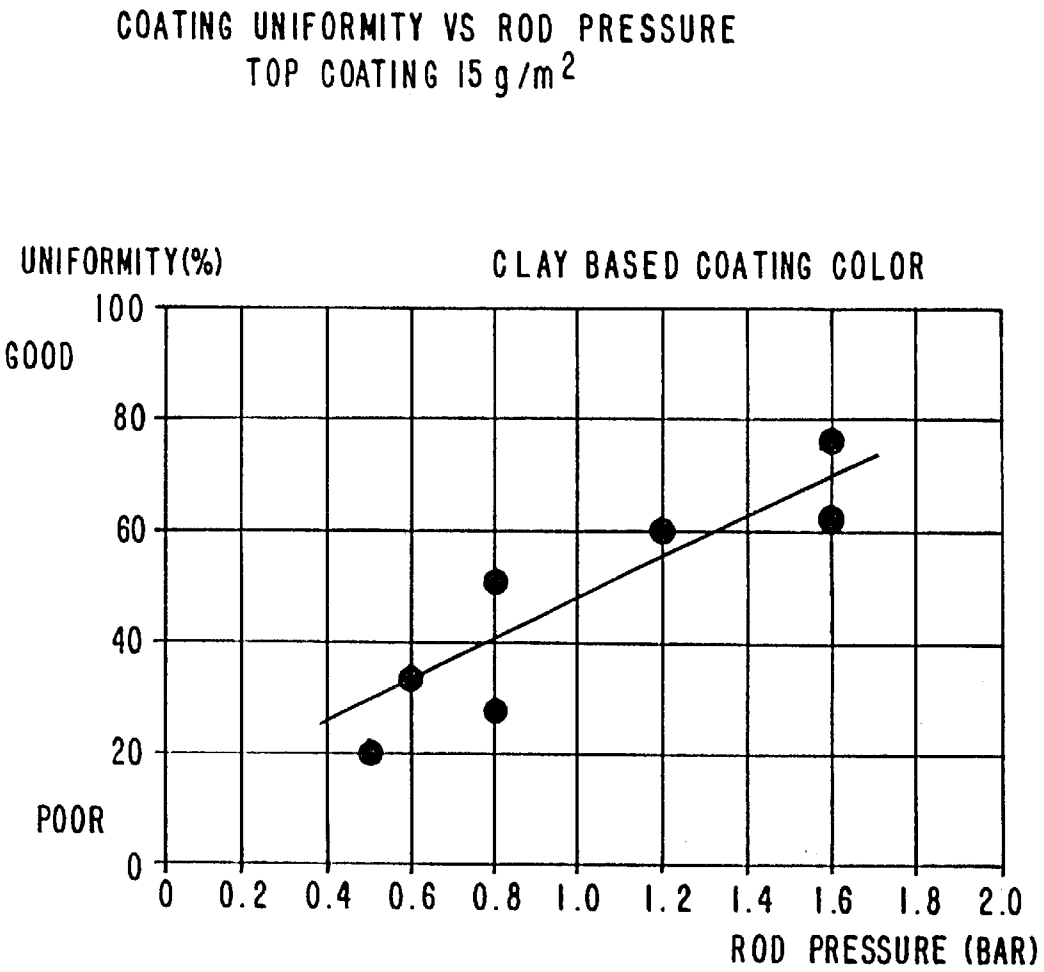
FIG. 9 is a diagram presenting the relation of the rod pressure to the uniformity of the coating layer.

FIG. 9 shows the effect of a high metering pressure on visual uniformity. The base board was unbleached carrier board and coating mix consisted of clay, calcium carbonate and titanium oxide pigments. The visual uniformity was assessed by a professional panel, and clear result was that the higher the metering pressure, the better the visual uniformity. The dwell distance was 1600 mm.

Figure 10:
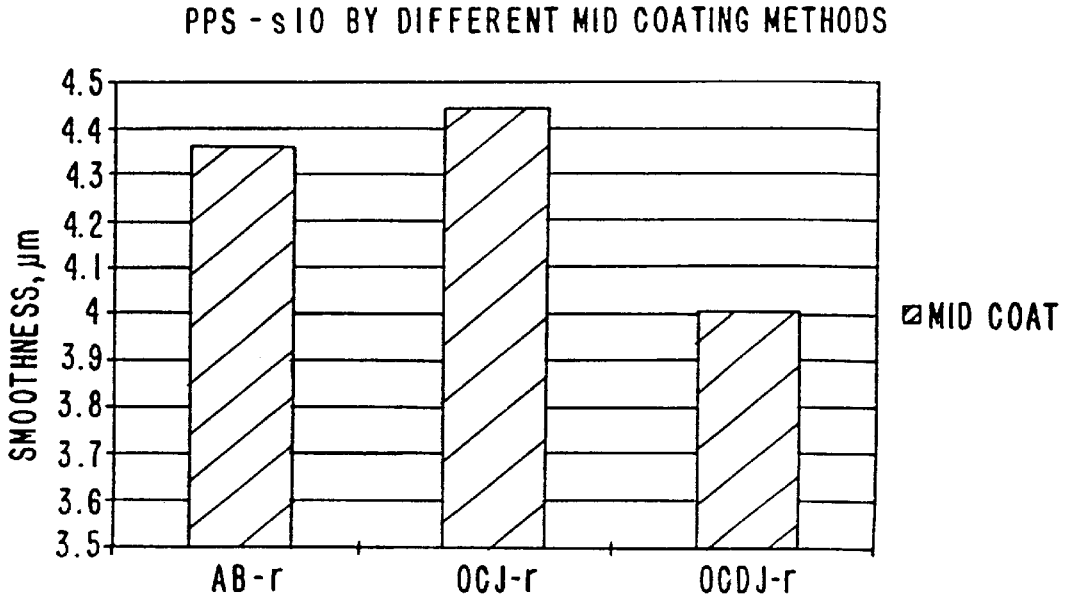
FIG. 10 is a diagram presenting the smoothness of the coating layer made with different coating methods.
Figure 11:
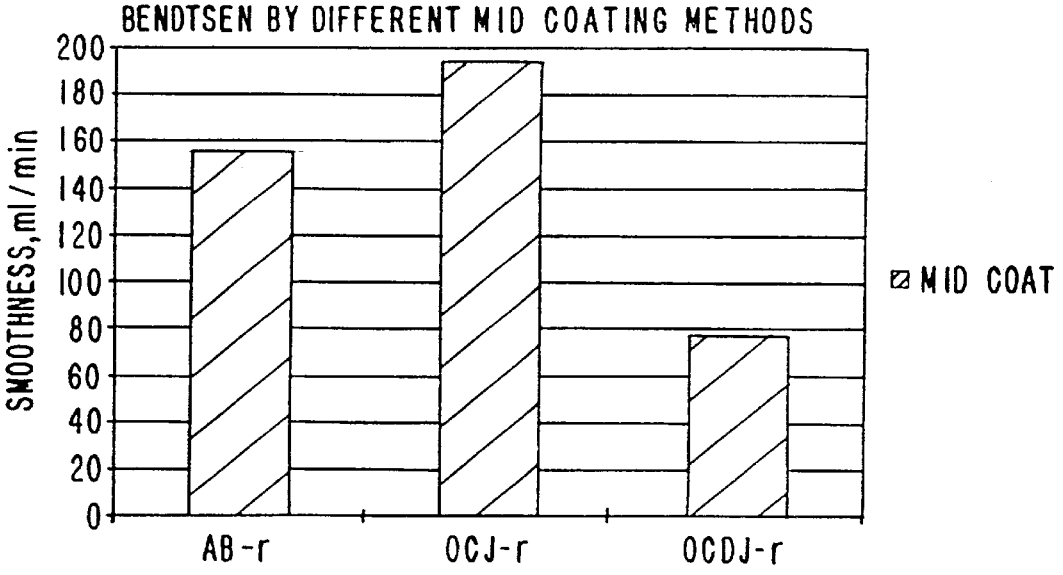
FIG. 11 is a diagram presenting the smoothness of the coating layer made with different coating methods.

The increase of smoothness due to long dwell time can be seen in FIGS. 10 and 11 which show PPS-s10 and Bendtsen smoothness of a second coating of white lined chipboard. AB-r is an application roll coater with rod metering (dwell distance 600 mm), OCJ-r is a jet coater with rod metering (dwell 450 mm) and OCDJ-r is a jet coater with rod metering and long dwell distance (1600 mm). Long dwell time gives the best smoothness with both methods.

The Pilot Coater Trials

The effects of the application method, dwell time and metering method on coated board properties were investigated on a pilot scale. The variables in the pilot coater were the application method, including premetered nozzle application (FIG. 6), open jet fountain applicator (FIG. 4) and application roll, the dwell distance, which was from 450 mm to 1600 mm, rod diameter, and rod or blade metering.

Two pilot trials were made. In the first trial, pre, mid and top coatings were investigated. In the second trial, precoating was made with application roll and only mid and top coatings were investigated.

The coating head comparisons in the pilot trials were run at a speed of 400 m/min, as it is a typical production speed today. However, there is practically no speed limitation in rod coating. The lowest speed run was 100 m/min and the highest 1000 m/min. There were no runnability problems in this speed range, giving for a long dwell time rod coater much better runnability than for an airknife.

The coating heads used in the trial are shown in Table 1, and the coating mix formulations used in the pilot trials in Table 2.

TABLE 1

The coating heads used in the pilot trials.

| APPLICATION METHOD | DWELL DISTANCE | METERING METHOD | ABBREVIATION |
|---|---|---|---|
| Application roll | Normal (600 mm) | blade | AR |
| Application roll | Normal (600 mm) | rod | AR-r |
| Premetered nozzle | Normal (800 mm) | airknife | AK |
| Premetered nozzle | Long (1600 mm) | blade | LP |
| Premetered nozzle | Long (1600 mm) | rod | LP-r |
| Free jet | Normal (450 mm) | rod | J-r |
| Free jet | Long (1600 mm) | blade | LJ |
| Free jet | Long (1600 mm) | rod | LJ-r |

TABLE 2

Coating mix formulations in pilot trials.

| | PRE COATING (color 1) | MID COATING (color 2) | TOP COATING (color 3) |
|---|---|---|---|
| American clay #2 | 50 | | |
| American clay #1 | | 52 | |
| Delaminated clay | 25 | | |
| Structurized clay | 25 | | |
| Calcined clay | | | 52 |
| Ground calcium carbonate | | 15 | 15 |
| Titanium dioxide | | 33 | 33 |
| PVAC-latex | 17 | 17 | 17 |
| CMC | 0.5 | | 0.8 |

TABLE 2-continued

Coating mix formulations in pilot trials.

| | PRE COATING (color 1) | MID COATING (color 2) | TOP COATING (color 3) |
|---|---|---|---|
| Polyvinyl alcohol | | 1.5* | |
| Solids, % | 62 | 62* | 60 |
| pH | 8.5 | 8.5 | 8.5 |

*On AK, 1.5 parts protein was used instead of PVOH. Solids on AK was 48%

The board was dried after every coating layer using an infrared dryer (ca 100 kW) and 4 air foils. The air velocity in foils was 25 m/s, at a temperature of 120 to 180° C.

The base board was a carrier board base, pre-calendered by a wet stack. The target total coat weight was 35 g/m$^2$, comprising pre coating 8 g/m$^2$, mid coating 18 g/m$^2$ and top coating 9 g/m$^2$. Final calendering was not carried out.

Rod Parameters and Some Trial Results

The traditional way to control coat weight in smooth rod metering is by means of the coating mix solids and rod pressure. Maximum runnable solids and viscosity levels frequently have to be used. In conventional rod coating, the coat weight control area is more limited than with blade.

It has been reported that relatively high metering pressure causes web compression during metering with a small angle blade. After the black nip, the web structure recovers to some extent. As a result, the coating layer has been formed to be more contour like. The situation described here has certain similarities with smooth rod metering at a high load.

Visual observations made during several trials indicate that a high rod metering pressure (1.5–2.0 bar) establishes a very even and highly opaque surface with less cloudiness than at a lower pressure. There is some evidence that when the diameter of the rod increases, the board will be rougher, but the effect is minor. The rotation speed of the rod (50–350 r/min) did not affect the quality of the board.

The trial results also confirmed that extremely high coat weights (10–20 g/m$^2$) can be reached with only single coating pass and rod metering by using a coating mix containing eminently high-shear viscosity properties (PVOH).

Some trials were also executed using dwell time between application and metering as a variable. A clear dependence between longer dwell time and higher coat weight was seen. Nevertheless, the effect of dwell time on coat weight often depends on the properties of the base sheet (porosity, absorption). The coat weight is usually 2–5 g/m$^2$ higher at a long dwell time. Board properties such as smoothness, gloss and visual uniformity were also improved by a long dwell time. The excessive drying of the coating mix before metering was not a problem.

Board Properties

The basic board properties discussed are PPS-s10 smoothness and Hunter gloss. Coverage is discussed too. A professional panel, which estimated the visual uniformity of the board sample, was used to evaluate coverage.

First Trial

Several coating head combinations were used in this trial. The smoothness level after precoating varied from 3.2 to 4.6 μm. In blade precoating, premetered nozzle application gave 0.3–0.5 μm better PPS-s10 smoothness than free jet application. There was no difference in appearance or coverage after precoating. After triple coating, there was still a 0.2–0.3 μm difference in the smoothness of premetered nozzle and jet application in precoating.

It is beneficial to precoat with a blade. Blade precoating gives a very smooth surface. The PPS-s10 difference between blade and rod metering is 0.8–1.1 μm. If blade coating is carried out on a brown base board, the visual appearance is much worse than after rod metering. There is a great deal of coating color in the valleys of the surface, but the hills are almost uncovered. When a stiff blade is used, the phenomenon of a bent blade giving greater contour precoating is emphasized.

After mid coating by rod, the stiff blade precoated sample was the most uniform. The next was bent blade precoated, while the rod precoated was the worst. It is obvious that filter cake formation in the mid coating is convenient after blade precoating. Filter cake formation is then greatest on the hills of the surface and weakest in the valleys. This is very beneficial to the coverage, and the mottle of the precoating cannot be seen after mid coating. The mid coating layer is the main factor when making coverage, due to the high coat weight and high titanium dioxide content of the coating mix.

There is a slight difference between premetered nozzle and free jet application in mid coating, when the metering is done by a smooth rod. The visual appearance is a little better after the free jet. The PPS-level is about the same.

When the final metering of the coating is performed with a smooth rod, a high rod pressure gives good coverage and surface smoothness.

Figure 13:
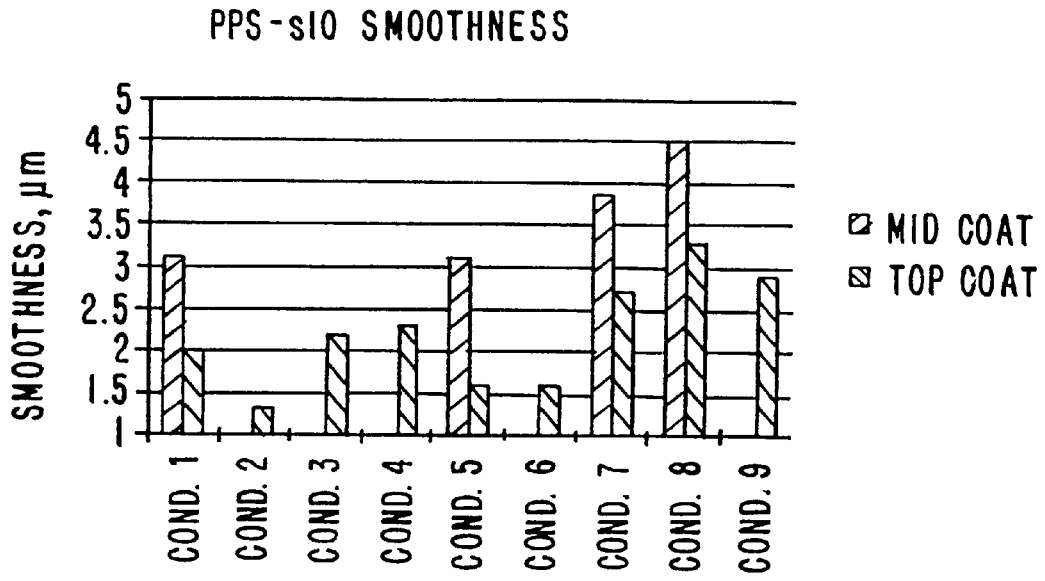

It can be seen in FIG. 13 that in the final product, the premetered nozzle gives 0.3–0.7 μm better PPS-s10 smoothness than free jet application, in bent blade metering (cond. 1 vs. 2). If the final metering is done with a smooth rod, the effect of the application method is minor (cond. 3 and 4). The PPS-smoothness is 0.1–0.9 μm better after blade metering than after rod metering (cond. 2 vs. 3, cond. 1 vs. 4 and cond. 6 vs. 7).

Figure 14:
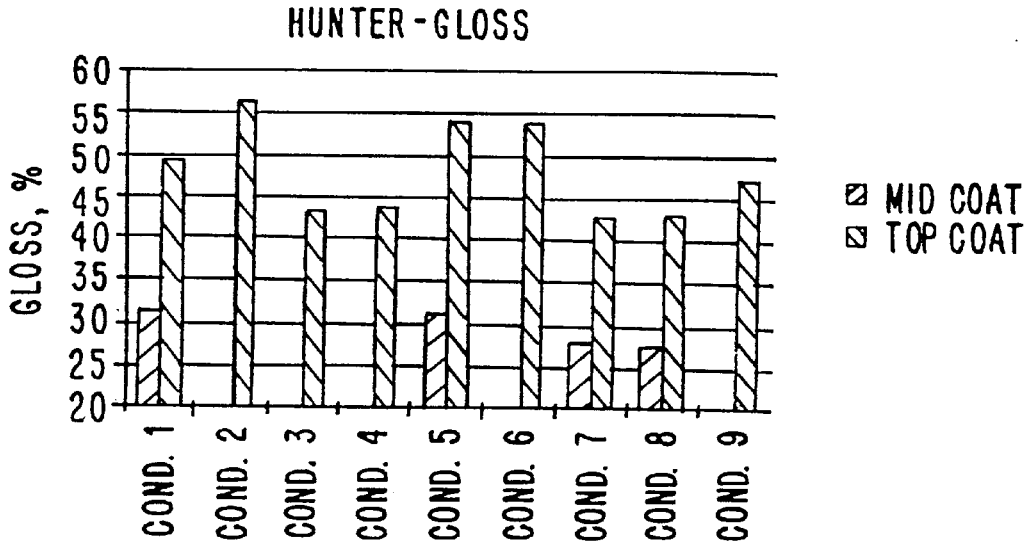

FIG. 14 shows the Hunter-gloss after mid and top coating. The difference between rod and blade in gloss is 3 units after mid coating. The blade mid coated was not visually acceptable. The effect of blade metering is about 10 units in top coating (cond. 2 vs. 3, cond. 1 vs. 4 and cond. 6 vs. 7). The better gloss of blade metering is due to the smoother surface.

Figure 15:
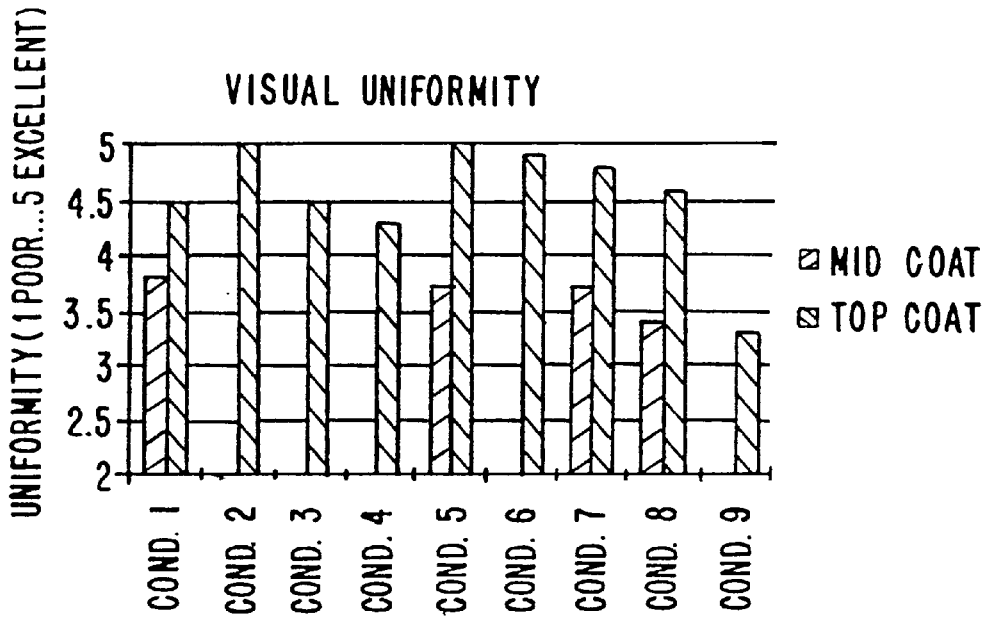

Visual appearance was the best, when a combination of premetered nozzle applicator with a long dwell time and a blade was used in precoating and top coating, and a long dwell time jet with a rod in mid coating (cond. 1). The worst was a combination comprising a long dwell time jet with a rod in pre and mid coating and premetered nozzle with a long dwell time and a blade in top coating (cond. 9). FIG. 15 also shows the visual uniformities of the samples.

The summary of the first trial is shown in Table 3. The values were measured after top coating.

TABLE 3

Summary of the first trial.

| Conditions | Coating heads | Visual uniformity | PPS-s10 | Hunter-gloss | ISO-brightness |
|---|---|---|---|---|---|
| 1 | LP + LJ – r + LJ | 4.5 | 2.0 | 49.5 | 85.0 |
| 2 | LP + LJ – r + LP | 5.0 | 1.3 | 56.5 | 84.5 |
| 3 | LP + LJ – r + LP – r | 4.5 | 2.2 | 43.5 | 84.5 |
| 4 | LP + LJ – r + LJ – r | 4.3 | 2.3 | 44.0 | 84.0 |
| 5 | LJ(r) + LJ – r –LP | 5.0 | 1.6 | 54.0 | 85.0 |

TABLE 3-continued

Summary of the first trial.

| Conditions | Coating heads | Visual uniformity | PPS-s10 | Hunter-gloss | ISO-brightness |
|---|---|---|---|---|---|
| 6 | LJ + LJ − r + LP | 4.9 | 1.6 | 54.0 | 84.5 |
| 7 | LJ + LJ − r + LP −r | 4.8 | 2.7 | 43.0 | 84.0 |
| 8 | LJ − r + LJ − r + LJ − r | 4.6 | 3.3 | 43.5 | 85.0 |
| 9 | LJ − r + LJ − r + LP | 3.3 | 2.9 | 48.0 | 84.5 |

Second Trial

Figure 16:
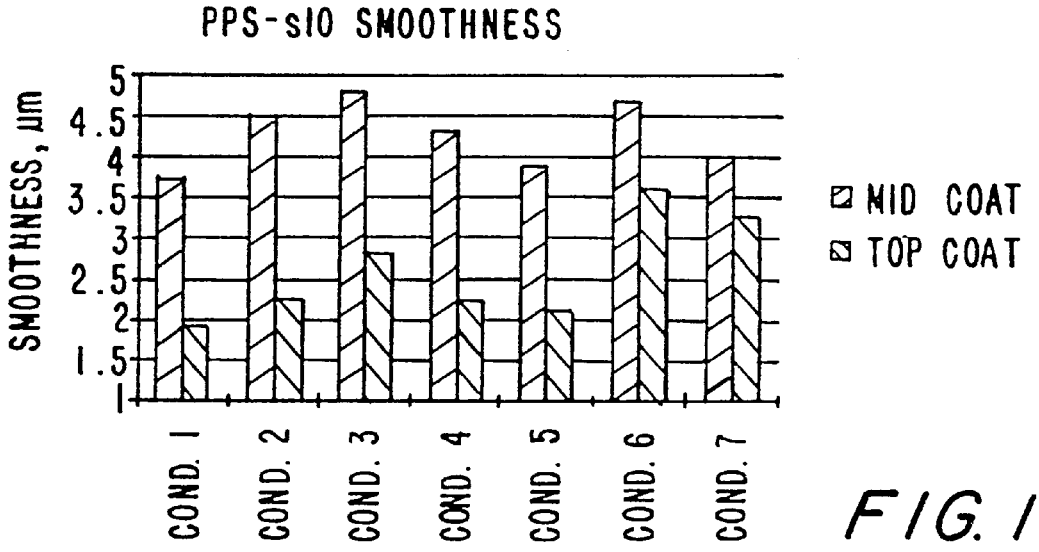

Also in this trial several coating head combinations were used. Precoating was carried out using an application roll coater metered by a stiff blade. The PPS-s10 smoothness was between 4.9–5.5 after precoating (this is about the same level as after free jet application in the first trial). The smoothness after mid and top coatings is shown in FIG. 16. The smoothest sample after mid coating was that with roll application and blade metering (cond. 1). The jet application with a long dwell time and rod metering gave almost the same smoothness (cond. 5 and 7). Airknife mid coated samples had the worst smoothness after mid coating (cond. 3 and 6). The smoothness difference between application roll coater and airknife was 1.1–1.2 $\mu$m.

In the final product, the sample coated three times with an application roll blade was the smoothest (cond. 1). The PPS-s10 was 1.8 $\mu$m, but the visual appearance was poorer than that of the rod or airknife mid coated samples. The long dwell time rod coater in mid coating gave a 2.1 $\mu$m final smoothness, while a normal dwell time rod coater with jet application gave 2.2 $\mu$m after blade top coating. The final smoothness after airknife mid coating was 2.8 $\mu$m. An application roll rod top coater was tested on airknife and long dwell time rod coated samples. The rod produced a smoothness 1.2–0.8 $\mu$m poorer than the blade in top coating (cond. 3 vs. 6 and cond. 5 vs. 7).

Figure 17:
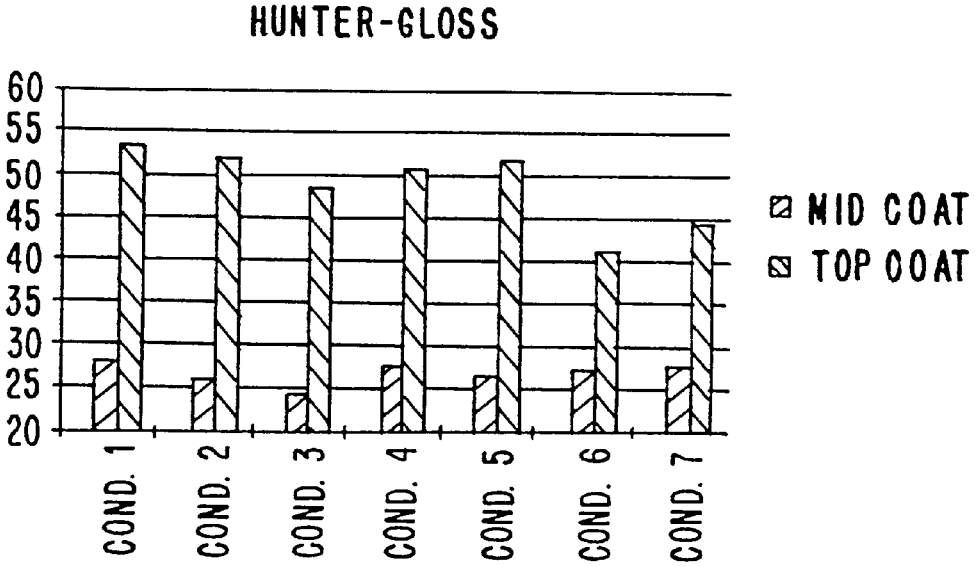
FIGS. 13, 14, 15, 16 and 17 show test results of pilot trials.

The Hunter-gloss of the samples was measured after mid and top coating. FIG. 17 shows the glosses. The best gloss after mid coat was in the applicator roll blade coated sample, 28% (cond. 1). There were no big gloss differences between coaters after mid coating. The worst gloss was measured in the airknife coated roll (cond. 3), 24.5%, though another airknife mid coated roll (cond. 6) was 27%.

The summary of the first trial is shown in table 4.

TABLE 4

Summary of the second trial.

| Conditions | Coating heads | Visual uniformity | PPS-s10 | Hunter-gloss | ISO-brightness |
|---|---|---|---|---|---|
| 1 | AR + AR + AR | 4.1 | 1.9 | 53.5 | 84.5 |
| 2 | AR + AR − r + AR | 4.2 | 2.2 | 52.0 | 85.0 |
| 3 | AR + AK + AR | 4.3 | 2.8 | 48.0 | 83.5 |
| 4 | AR − J − r + AR | 4.2 | 2.2 | 50.5 | 85.0 |
| 5 | AR + LJ − r + AR | 4.3 | 2.1 | 51.5 | 85.0 |
| 6 | AR + AK + AR − r | 4.5 | 3.6 | 41.0 | 83.5 |
| 7 | AR + LJ − r + AR − r | 4.6 | 3.3 | 44.5 | 84.5 |

As observed, the properties of the rod coated samples were better than those of the airknife coated samples. It could be seen that the surface of the board is better covered and smoother after a long dwell time rod coater than after an airknife coater. The airknife coated sample was much rougher and the coating mix had penetrated the structure of the board to a greater extent.

Conclusions

The nozzle application technology has become very popular in paper coating. This technology also gives benefits in relatively low speed board grade applications. Pilot trials showed that free jet application is beneficial when making a good coverage. However, a long dwell time is needed for a thick filter cake formation and high coat weights, if an airknife is to be replaced. Rod metering gives more contour-like coating than blade metering.

This study suggests that, in board coating, nozzle application, a long dwell time, and rod metering give excellent coverage and a smooth surface. Board can be coated without airknife technology, by the method investigated, while still achieving a quality comparable or even superior to that of an airknife. Of course, this method can be used for coating paper too.

Thus, while there have been shown and described and pointed out fundamental novel features of the invention as applied to preferred embodiments thereof, it will be understood that various omissions and substitutions and changes in the form and details of the method and apparatus may be made by those skilled in the art without departing from the the spirit of the invention. For example, it is expressly intended that all combinations of those elements and/or method steps which perform substantially the same results are within the scope of the invention. Substitutions of the elements from one described embodiment to another are also fully intended and contemplated. It is also to be understood that the drawings are not necessarily drawn to scale but they are merely conceptual in nature. It is the intention, therefore, to be limited only as indicated by the scope of the claims appended hereto.

What is claimed is:

1. A method for coating a paper or a paper board web, comprising:

spreading coating mix having a solids content of 55–75% on a surface of the web with a nozzle applicator to form a coating layer on the web; and levelling and metering the spread coating mix on the surface of the web with a doctor element capable of producing a hydrodynamic doctoring force on de coating layer between the doctor element and the web, the doctor element being located downstream of the applicator so that a dwell time between the spreading of the coating mix and the metering is 72–2400 ms and so that fibers of the web swell prior to metering.

2. A method according to claim 1, wherein the dwell time between the spreading of the coating mix and the metering is 72–1212 ms.

3. A method according to the claim 1 or 2, wherein the coating mix is levelled and metered by a smooth or grooved rod or a blade.

4. A method according to claim 1, wherein the amount of applied coating is 30–800 g/m$^2$, the viscosity of the coating mix is 80–140 mPas measured in a capillary viscosimeter at 200,000–650,000 l/s shear rate, the metering force is at least 1 kN/m and the metered coat weight is 8–25 g/m$^2$.

5. A method according to claim 1, wherein the web is run at a speed of 100–1000 m/min.

6. The method according to claim 5, wherein the web is run at a speed of 200–1000 m/min.

7. A method according to claim 1, wherein the doctoring force is at least equivalent to the metering force achieved by a tube pressure of 1.2 bar applied on the back side of a rod bed of a smooth rod having a diameter of 12 mm.

8. A method according to claim 7, wherein the doctoring force is at least 1 kN/m.

9. A method according to claim 1, wherein the web is supported by two backing elements the first backing element supporting the web during spreading of the coating mix and the second supporting the web during doctoring.

10. A method according to claim 1, wherein the web is supported by two backing elements, a first backing element supporting the web during spreading of the coating mix and a second backing element supporting the web during doctoring.

11. A method according to claim 1, wherein the web is supported by a single compressible backing element.

12. A method according to claim 1, wherein the dwell distance between the spreading of the coating mix and the doctoring is 1400–4000 mm.

13. A method according to claim 1, wherein the coating mix is spread on the web by a free jet nozzle applicator, premetering rod nozzle applicator or a premetering blade nozzle applicator.

14. An apparatus for coating a paper or a paper board web, comprising:

a nozzle applicator for spreading coating mix having a solids content of 55–75% on a surface of the web to form a coating layer on the web;

a doctor element for levelling and metering the spread coating mix on the surface of the web, the doctor element being capable of producing a hydrodynamic doctoring force on the coating layer between the doctor element and the web and being located downstream of the applicator so that a dwell time between the spreading of the coating mix and the metering is 72–2400 ms at a web speed of 100–1000 m/min. and so that fibers of the web swell prior to metering by the doctor element; and at least one backing element for supporting the web.

15. An apparatus according to claim 13, wherein the dwell time between the spreading of the coating mix and the metering is 72–1212 ms at a web speed of 100–1000 m/s.

16. An apparatus according to claim 14, comprising two backing elements for supporting the web, a first backing element for supporting the web during spreading of the coating mix and a second compressible element for supporting the web during doctoring.

17. An apparatus according to claim 16, wherein the backing elements are rolls.

18. An apparatus according to claim 16, wherein at least one of the backing elements is a shoe.

19. An apparatus according to claim 18, wherein the backing element of the doctor is a shoe.

20. An apparatus according to claim 14, comprising a single compressible backing element.

21. An apparatus according to claim 14, wherein the dwell distance between the spreading of the coating mix and the doctoring is 1400–4000 mm.

22. An apparatus according to claim 14, wherein the nozzle applicator is a free jet nozzle applicator, premetering rod nozzle applicator or a premetering blade nozzle applicator.

23. An apparatus according to claim 14, wherein the doctor element is a smooth or grooved rod or a blade.

* * * * *